US006976560B2

(12) United States Patent
Newby

(10) Patent No.: US 6,976,560 B2
(45) Date of Patent: Dec. 20, 2005

(54) SERVICE/EQUIPMENT EQUALIZATION DESTINATION SYSTEM FOR ELEVATORS

(76) Inventor: William Newby, 144 Pelican Reef Dr., St. Augustine, FL (US) 32080

( * ) Notice: Subject to any disclaimer, the term of this patent is extended or adjusted under 35 U.S.C. 154(b) by 328 days.

(21) Appl. No.: 10/411,652

(22) Filed: Apr. 12, 2003

(65) Prior Publication Data

US 2004/0200672 A1 Oct. 14, 2004

(51) Int. Cl.[7] ..... B66B 1/20
(52) U.S. Cl. ..... 187/383; 187/247
(58) Field of Search ..... 187/380, 382, 187/387, 247; 706/12, 13, 910

(56) References Cited

U.S. PATENT DOCUMENTS 4,046,227 A * 9/1977 Kirsch et al. ..... 187/387
4,111,284 A * 9/1978 Winkler et al. ..... 187/380
4,463,834 A * 8/1984 Polis et al. ..... 187/387
4,875,554 A * 10/1989 MacDonald et al. ..... 187/382
5,241,142 A * 8/1993 Thangavelu ..... 187/385
5,767,461 A * 6/1998 Nakagawa et al. ..... 187/382
2001/0002636 A1 * 6/2001 Siikonen ..... 187/382

* cited by examiner

*Primary Examiner*—Jonathan Salata

(57) ABSTRACT

An elevator car equalization computer program product includes software instructions for enabling a computer to perform predetermined operations, a computer readable medium bearing the software instructions, and a computer system including a processor and a memory. The predetermined operations include the steps of: (a) receiving at least one user input from at least one data input terminal; (b) determining a location of an originating demand unique to each of the user inputs; (c) determining a location of a destination demand unique to each of the user inputs; (d) calculating a total number of the user inputs received within a predetermined time interval; (e) determining whether the total number of user inputs is less than or more than a total number of available elevators; (f) assigning an elevator to each of the locations of the originating demand; and (g) forming temporary call response zones based upon the elevator assignments. The present system provides shorter average waits, transfer times, trip times, round trip times and equipment use.

8 Claims, 7 Drawing Sheets

SERVICE/EQUIPMENT EQUALIZATION DESTINATION SYSTEM FOR ELEVATORS

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to elevator systems and, more particularly, to a control system for equalizing and directing elevator car usage assignments.

2. Prior Art

Virtually all "Elevator Group Systems" (conventional two button or destination type) of recent invention have been based on "Cost of Service" algorithms (e.g.: Shortest waiting times) using as few elevators in the group as possible, with no regard for equalization of service characteristics or equipment use. The results are lower average service characteristics, (waiting times, trip times, car loading, etc.) but a wide range of individual characteristics. (Some passengers have short waits and trip times while others have long waits and trip times.)

The net result of these designs is also that individual car utilization is disparate. (Elevator Cars often become underutilized while others are overused.)

In virtually all present systems the passenger destination times, (the sum of waiting+loading+travel times) is the target and is paramount. No effort is made to equalize service to all passengers, equalize use of equipment, minimize total system stops or minimize trip and round-trip times.

Zone/demand assignments, under the SEEDS system, shall be related to the individual car and shall be totally fluid rather than fixed and related to landings.

Accordingly, a need remains for an elevator car usage assignment system to overcome the above-noted shortcomings. The present invention satisfies such a need by providing a destination based elevator group supervisory system designed to equalize service and equipment use. Such a system will minimize the range of system service characteristics to the greatest degree possible and results in shorter average waits, transfer times, trip times, round trip times, and equipment use. As a result, the system will provide greater elevator car availability and optimum demand response.

BRIEF SUMMARY OF THE INVENTION

In view of the foregoing background, it is therefore an object of the present invention to provide a system for equalizing elevator car usage. These and other objects, features, and advantages of the invention are provided by a computer program product for enabling a computer to equalize service characteristics and equipment usage in an elevator group supervisory system.

This destination based elevator group supervisory system is designed to equalize service and equipment use. The equalization of service and the equalization of equipment use, as this system's primary target, will minimize the range of system service characteristics to the greatest degree possible. The results (rather than the target of the system) will be shorter average waits, transfer times, trip times, round trip times and equipment use. The result; fewer total system stops and shorter trip and round trips times, will provide greater elevator car availability and optimum demand response.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
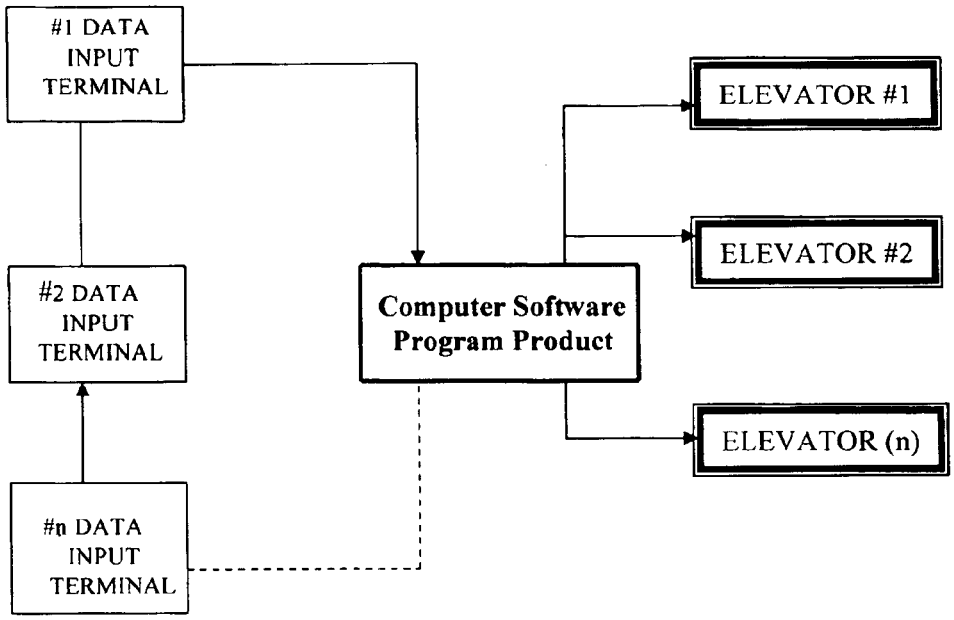
FIG. 1 is a schematic block diagram showing the computer software program product and associated steps, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–5 by the reference numeral 10 and is intended to provide a service/equipment destination equalization system for elevators. It should be understood that the system 10 may be used to equalize the assignments of various elevator systems and should not be limited to use only with destination type elevator systems.

The elevators shall be arranged for group operation as defined by the ANSI/ASME A17.1 Code and CABO/A1117.1 1997 for elevators controlled by a group supervisory system.

Figure 5:
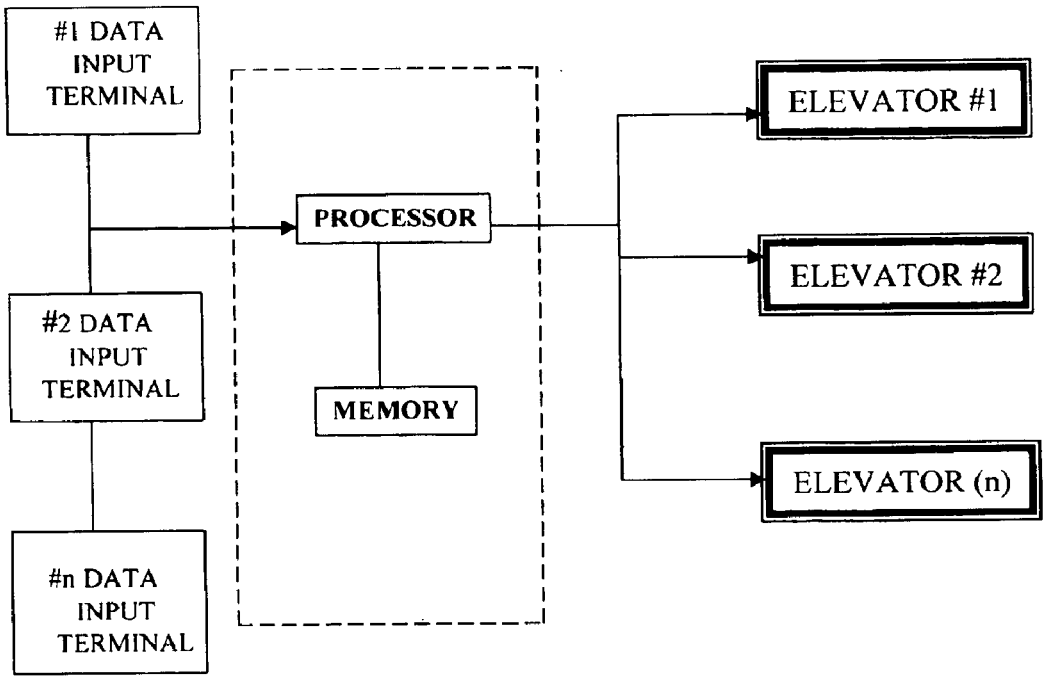
FIG. 5 is a schematic block diagram showing the computer system and associated steps.

Referring to FIGS. 1 and 5, all elevators shall be arranged for automatic operation without attendant. The control of the elevator shall be completely automatic through data input terminals (DIT's) and a central group processor or ring of car processors as well as peripheral input devices (ADA, Security, Communication, etc.).

DIT's shall consist of a means of registering a passenger's desired destination or special function requirement and a visual and audible device to indicate the assigned elevator, its location or other relevant information.

The DIT's shall automatically insert a demand into the dispatching system and an elevator shall be assigned to that demand. The demand shall be defined by ORIGIN (location of DIT or peripheral device) and by desired DESTINATION.

The starting of a car shall be contingent upon the establishing of the door interlock circuit. The cars shall automatically slow down and stop level at the floors in response to DIT assignments. Stops shall generally, but not necessarily, be made in sequence, irrespective of the order in which the DIT assignments are made. Provisions shall prevent more than one car from responding to the same call.

The demand shall be assigned to a car in the most equitable means, considering the equalization of all system service characteristics and the equalization of equipment utilization.

Passengers shall be directed to board specific cars, thereby assuring that system management criteria is not diminished by passenger misdirection. Elevator boarding patterns will be organized in that passengers will queue in front of their assigned elevators rather than in an arbitrary grouping throughout the elevator lobby.

CAR SELECTION CRITERIA

The Service/Equipment Equalization Destination System (SEEDS) shall be arranged to equalize service to all demand origins and destinations, so as to prevent extended waits and trip times. All cars shall be available for assignment to all demands at any time, except those cars on special operational assignments. Under all traffic conditions, the equalization of origin/destination, car assignments shall be paramount.

The DIT's are the primary passenger devices required to input passenger movement demands. The SEEDS system shall receive complete data on passenger origin, destination and volume, shall analyze the data and instantly assign cars in order to best serve the total system demand.

Figure 7:
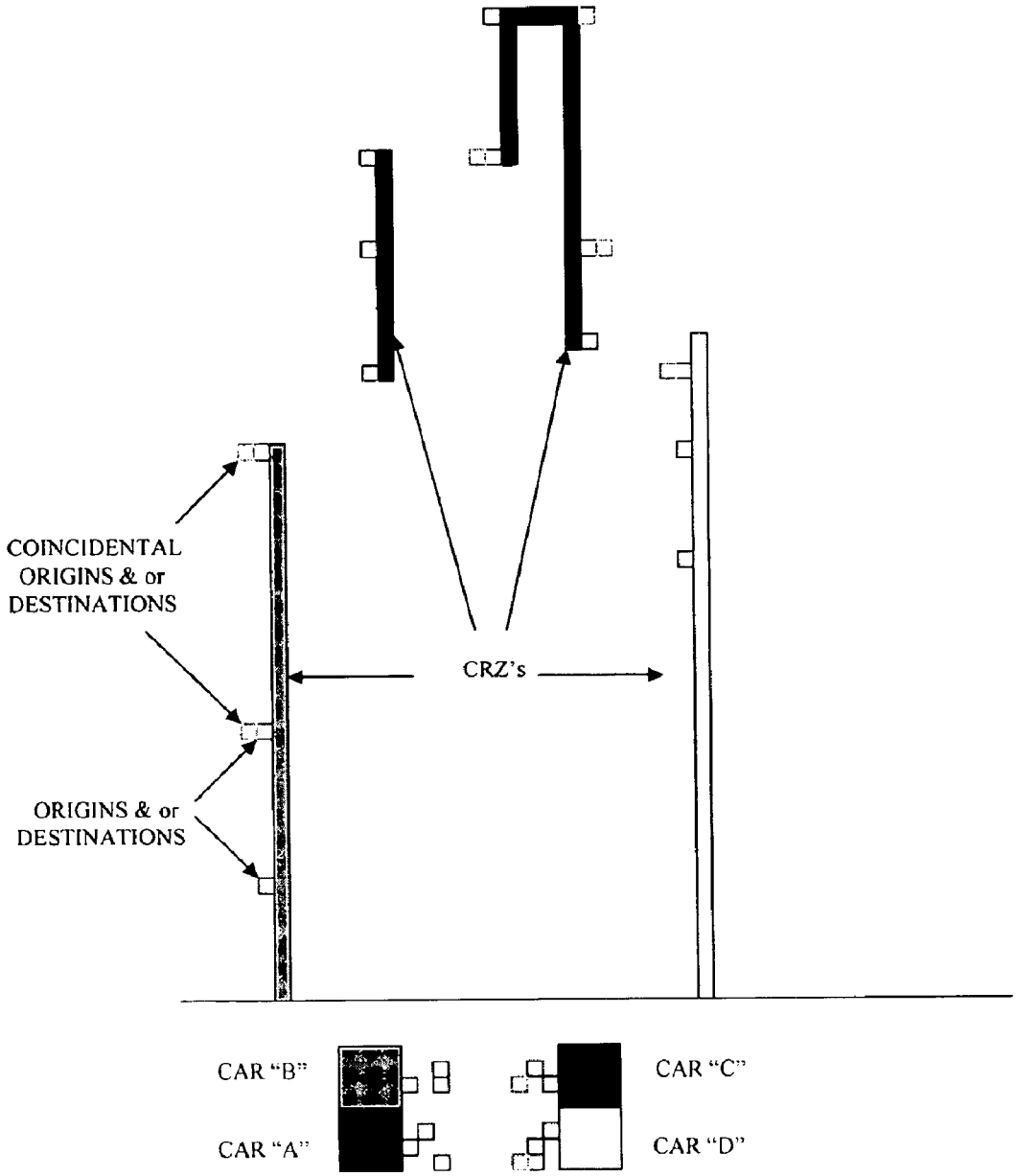
FIG. 7 is a schematic diagram showing the equalization of cars on an assigned basis.

Referring to FIG. 7, SEEDS shall minimize and equalize by car, the number of system stops and round trip times required to handle a given volume of traffic, thus reducing overall passenger/elevator system interface times and the range of those times.

The SEEDS system shall consider the number of calls versus the number of cars in service and shall, based on the system algorithm, make immediate assignments, equalizing to the greatest degree possible, the number of assignments made to each car. This process will eliminate limitation of the number of destinations assigned to an individual car and the subsequent inability of the system to respond to demands. Only when the number of system calls is less than the number of available cars, shall the shortest passenger destination times, (the sum of waiting+loading+travel times) be paramount.

Figure 2:
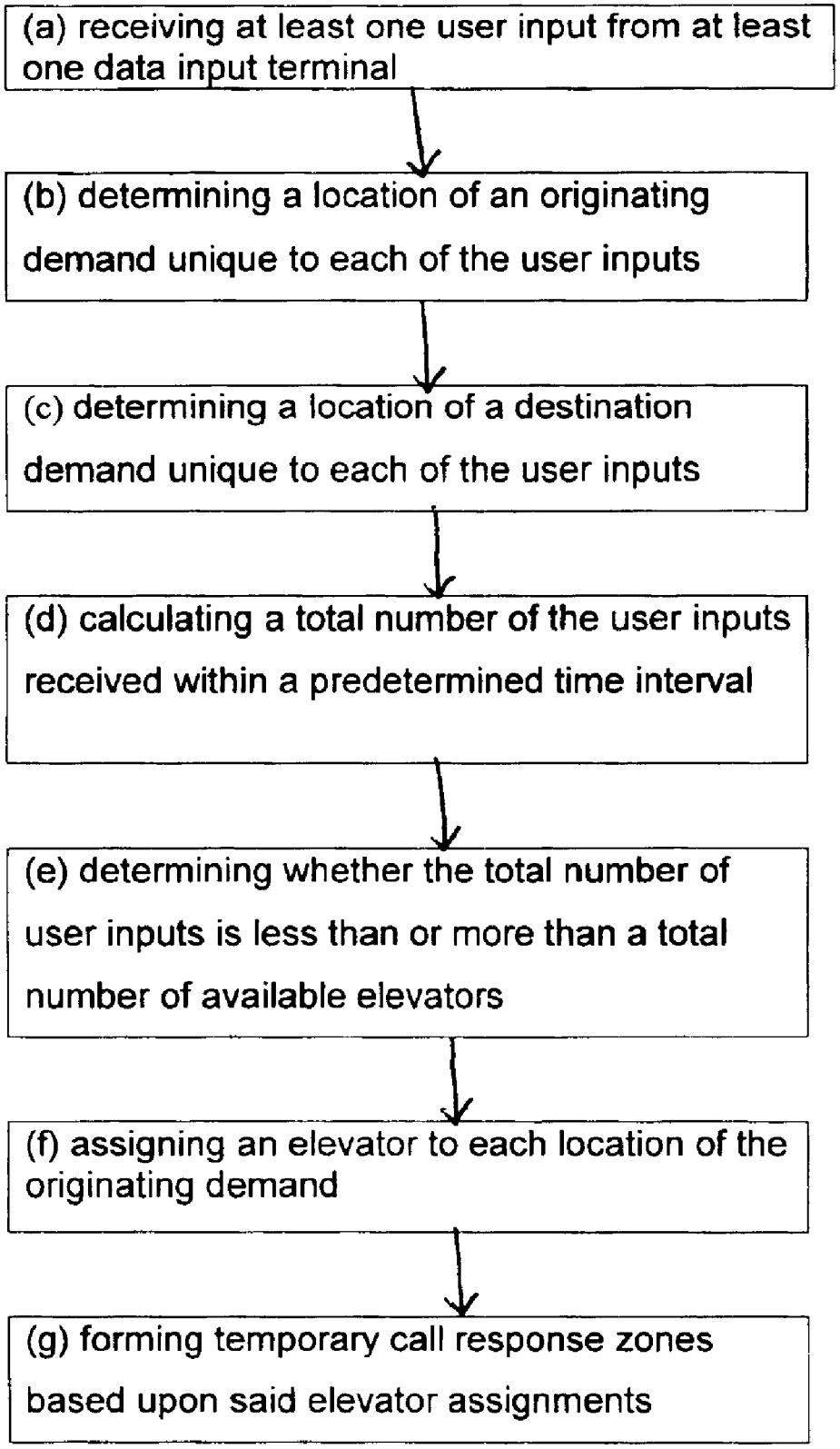
FIG. 2 is a schematic block diagram of the software instructions for the computer system.
Figure 3:
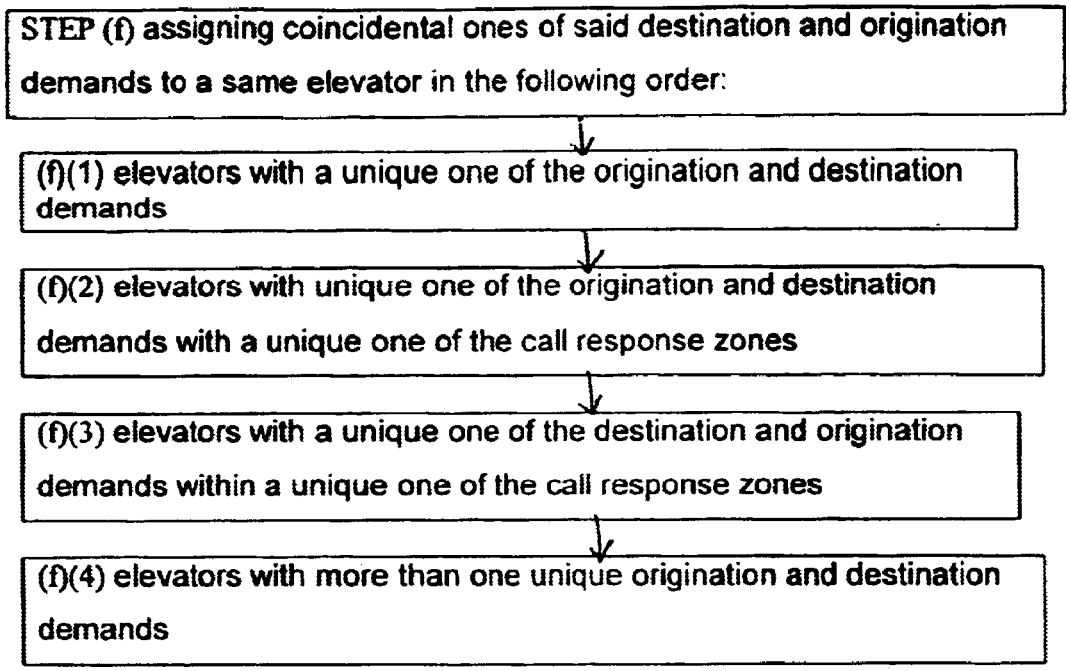
FIG. 3 is a schematic block diagram of step (f) of the computer program product.

Referring to FIGS. 2–3, assignment of ORIGIN/DESTINATION demands shall be made based on the following criteria:

System calls shall be assigned to cars in such a way that all cars receive the same number of assignments. (e.g.: eight different ORIGIN or DESTINATION demands entered into a four car system shall result in a two call per car assignment.)

Figure 6:
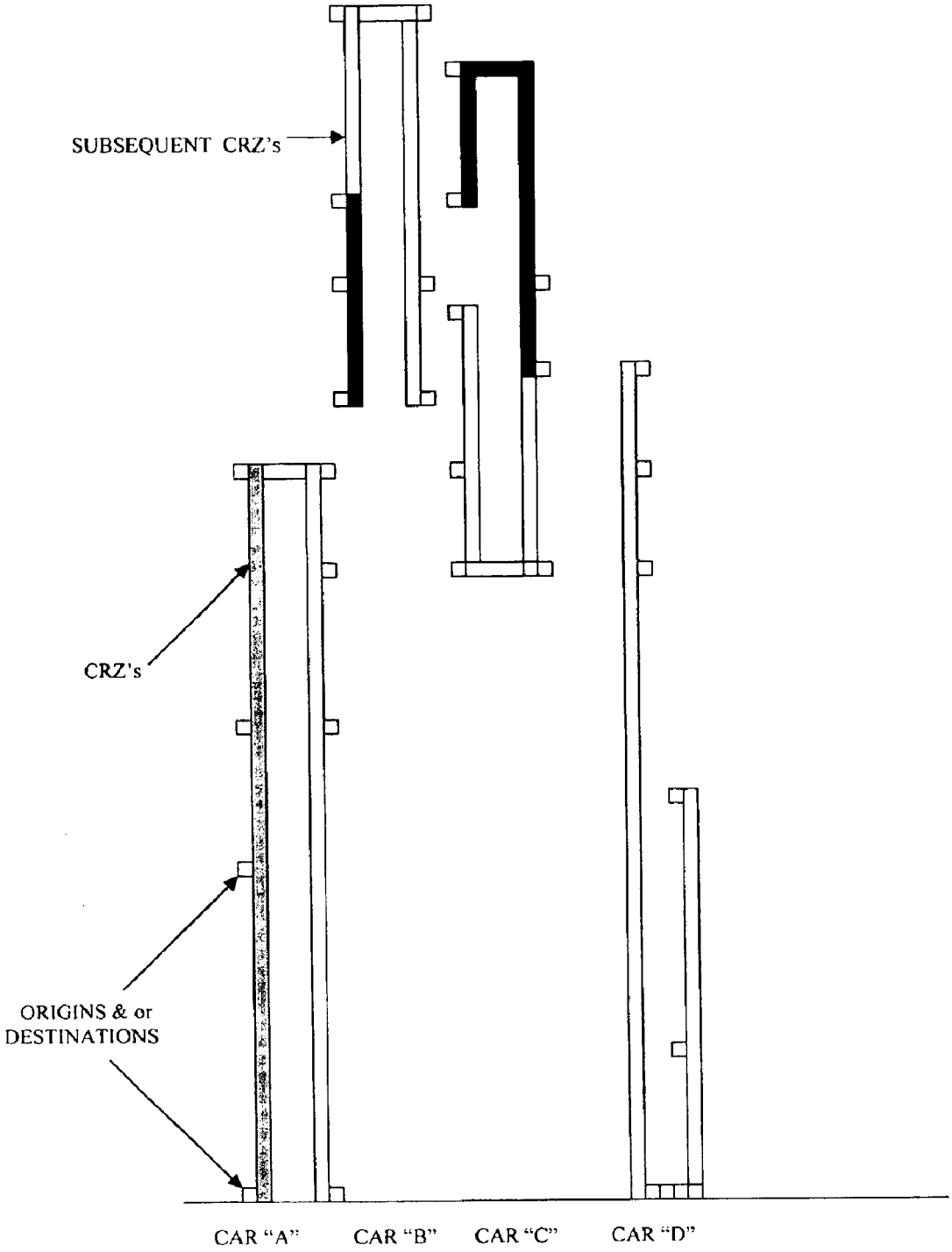
FIG. 6 is a schematic diagram showing the creation of car response zones (CRZ's)

Referring to FIGS. 6 and 7, the system will assign coincidental destinations and origins to the same car, to the highest degree practical.

The system will assign origins and destinations to contiguous or near contiguous floors, based on looking ahead at two directional changes.

The system shall form temporary "Car Response Zones" (CRZ's) based on the call assignments on a particular car. Temporary CRZ's shall be created consisting of the first remaining assigned car call floor and the floors beyond the last assigned car call, ending at the next cars CRZ. This process will eliminate disparate assignments and reduce the round trip of each car.

The number of floors in a temporary zone shall be, not less than the number of floors served divided by the number of cars in service. Temporary CRZ's may overlap. Temporary CRZ's shall be re-established when the number of assigned car calls becomes less than the average number of car calls assigned to all cars.

When a car has no call assignments, its temporary CRZ shall remain until call assignments resume.

When a heavy specific ORIGIN to DESTINATION demand occurs, based on the number of DIT registrations, additional elevators shall be assigned to service that demand. Cars determined to be fully loaded will not be eligible for intermediate assignments beyond those previously assigned. ORIGINS and DESTINATIONS coincidental to those already assigned for that trip may be accepted. This heavy demand response shall be done in such a way as to equalize service to all demands.

An allocation that would cause a car to arrive in advance of the passenger arrival, shall be provided with limited extra "door hold open" time so that the elevator doors would not close before the intending passenger could enter the elevator. The extra time may be reduced to a minimum when the entering passenger breaks the door protection beam and the beam is reestablished.

In making this determination, the momentary location of the traveling passenger shall be considered by virtue of floor location and the walking distance to the cars from individual DIT's.

The SEEDS supervisory control shall be based on an "equalization-of-service and equipment use" algorithm. Its primary objective is to equalize service characteristics and equipment use. The equalization of service and the equalization of equipment use, as this system's primary target, will optimize the range of system service characteristics (total passenger destination times, total system stops, round trip times, handling capacity, etc.). The least total number of system stops and shortest round trip times shall be a direct result rather than a target of the SEEDS algorithm.

In this fashion the total call registration to destination time for all passengers in the system shall be kept to a minimum, as will the range of these characteristics.

Figure 4:
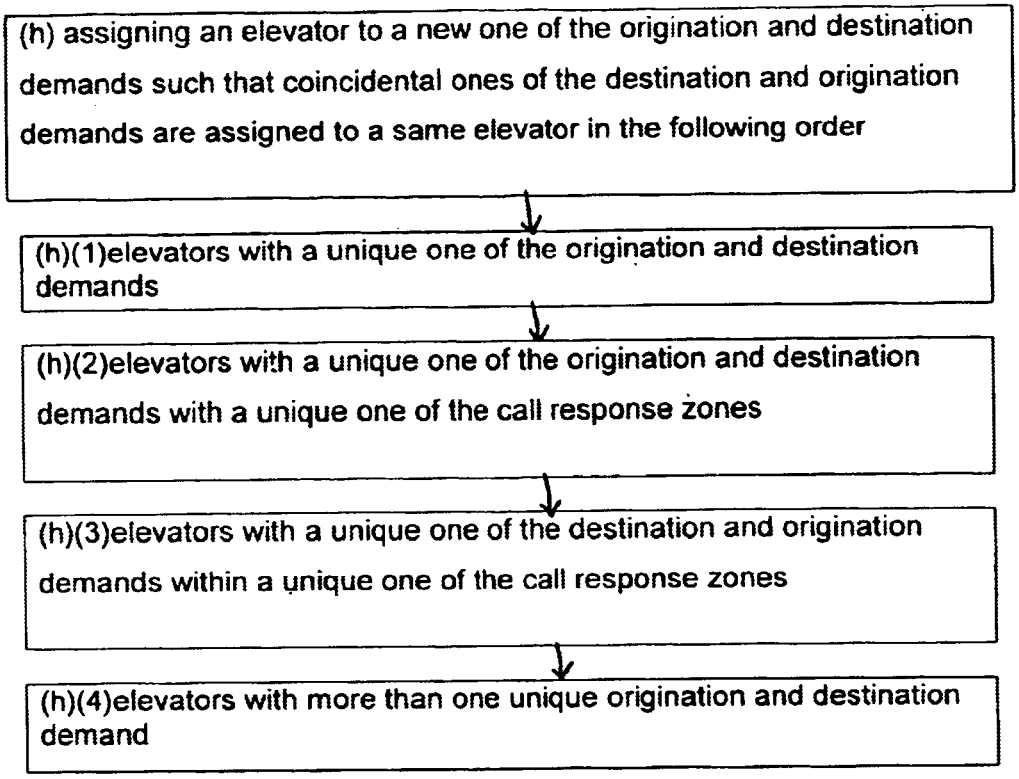
FIG. 4 is a schematic diagram of step (h) of the computer program product.

Now referring to FIG. 4, the ORIGIN/DESTINATION assignment process "System Response Cost" (SRC) of a new demand is comprised of 4 primary components:

The number of DIT demands shall be divided equally among the total number of cars in service and assigned based upon the location of the "Car Response Zones" (CRZ's) of each car.

System calls shall be assigned to cars in such a way that all cars receive the same number of assignments. (e.g.: eight different ORIGIN or DESTINATION demands entered into a four car system shall result in a two call per car assignment.)

The system will assign coincidental destinations and origins to the same car in the following order:

a) Cars with the same origin and destination.

b) Cars with the same origins, and destinations within the same CRZ.

c) Cars with the same destinations, and origins within the same CRZ.

d) Cars with the same origins or destinations.

The system will assign origins and destinations to contiguous or near contiguous floors, based on looking ahead at two directional changes. No car shall be assigned calls within a greater range than the number of floors served by the group divided by one less than the number of cars in the group.

The system shall form temporary "Car Response Zones" (CRZ's) based on the call assignments on a particular car. Temporary CRZ's shall be created consisting of the first remaining assigned car call floor and the floors beyond the last assigned car call, ending at the next cars CRZ. This process will eliminate disparate assignments and reduce the round trip of each car.

The number of floors in a temporary zone shall be, not less than the number of floors served, divided by the number of cars in service. Temporary CRZ's may overlap. Temporary CRZ's shall be re-established when the number of assigned car calls becomes less than the average number of car calls assigned to all cars.

During heavy up-peak traffic originating at the main entry level, that level shall be included in each car's temporary CRZ but shall not be considered as the first or last assigned call. During heavy down-peak traffic when the main entry level is the primary destination, that level shall be included in each car's CRZ but shall not be considered as the first or last assigned call.

When a car has no call assignments, its temporary CRZ shall remain until call assignments resume. New calls shall be assigned based on the following order:

The system will assign coincidental destinations and origins to the same car in the following order:

a) Cars with the same origin and destination.

b) Cars with the same origins and destinations within the same CRZ.

c) Cars with the same destinations and origins within the same CRZ.

d) Cars with the same origins or destinations.

A call whose ORIGIN and DESTINATION are within a car's temporary CRZ on a car with no assignments.

A call whose ORIGIN is within a car's temporary CRZ on a car with no assignments.

A call whose ORIGIN and DESTINATION are outside a cars temporary CRZ on a car with no assignments.

A call whose ORIGIN and DESTINATION are within a car's temporary CRZ on a car with fewer than the mean call assignments.

A call whose ORIGIN is within a car's temporary CRZ on a car with fewer than the mean call assignments.

A call whose ORIGIN and DESTINATION are outside a cars temporary CRZ on a car with fewer than the mean call assignments.

New calls are accepted and can be assigned to cars with up to two directional changes ahead.

The SEEDS "equalization-of-service and equipment use" supervisory algorithm shall operate as the sole system in service to all traffic demands. SEEDS is a singular solution for Up-Peak, Down-Peak, Inter floor or Off-Peak traffic or any combination thereof.

Cars will park based on the following priorities:

1. During light through peak traffic demands, cars will park at the last landing served and shall be available for immediate assignment.

2. Cars will only be zoned to serve specific tenant needs.

3. If main lobby traffic is heavier than other traffic, more than one car may be sent to the lobby, subject to real time demand.

4. In the absence of demands for a period of not less than five minutes, the cars shall remain at their last assignment except in cases where specific zone assignments are required. Cars will park with doors closed until an assignment is made.

System parameters may be changed based on individual application requirements.

The following features shall be provided by the SEEDS as appropriate:

Interrupted-Service Alert—If a car with assigned boarding stops goes out of service or is fully loaded resulting in a bi-pass prior to reaching the boarding floors, the waiting passengers at these floors shall be informed and asked to reenter their destination. These voice announcements are to be made at the floor enunciators.

Nuisance Calls—If a car responds to a boarding call and no passenger transfer occurs, the corresponding destination calls from that floor will be canceled. Floors that continually log nuisance calls will cause an alert to be communicated to an appropriate location.

Approach Time, Passenger v. Car—Passenger approach times, DIT to car entrance are compared to car approach times. Approach times will be considered in the assignment process. Cars forecast as arriving prior to passengers will not be assigned unless arriving empty and without further bookings; in this case the door-hold-open time will be extended to accommodate the approaching passenger.

Assignment By-Rule—A car assigned to stop at a floor when traveling in one direction will not be assigned a boarding stop at this floor for the opposite direction of travel, except when the stop is at the floor of direction reversal. This eliminates the chance of passengers entering a car and traveling in the wrong direction and reaching their destination only after a detour and direction reversal.

Handicap Operation—In addition to the DIT's destination registration means each floor terminal is to be supplied with a button engraved with the International Handicap Access wheelchair symbol. This button is to be the initiating button for handicapped passenger procedures. When a "wheelchair" button is pressed, a special journey mode shall be initiated, as prescribed under the CABO/A117.1 proposal. The following operation shall be enabled:

The destination is registered in a conventional manner.

Car assignment is confirmed both visually and by a tone that is repeated at the entrance identification lantern of the car assigned that call. The car identification lantern is illuminated and flashes to coincide with the audible signal at the DIT confirming to partially sighted and blind persons which car has been assigned.

The assignment is announced at the DIT (e.g. "take car A") and car A announces its location.

The assigned car will be selected according to:

Space inside the car to permit a wheelchair user to board.

The ETA of the car must be later than the ETA of the passenger at the boarding entrance, assuming an extended 2–3 seconds per yard passenger approach time.

Preference for no exiting passenger for the boarding floor.

Upon arriving at the destination and opening the doors the elevator shall announce the open status of the doors and automatically extend the door "hold open time" to permit comfortable egress. The door operation shall be modified to initiate a slow closing of the doors. The car shall then return to normal service.

Other Features such as Independent Service, Firemen's Service, Code Blue, VIP etc., shall be provided through code entry or peripheral device and shall operate in traditional fashion. Hidden operating devices shall be exposed inside the car to accommodate these special operations.

The SEEDS will be arranged to provide restricted floor features as follows:

a) On a per floor basis for destinations only. This restriction shall be arranged to be over-ridden by a card key over-ride.

b) A signal in the DIT shall indicate registration of a restricted destination.

c) Control shall also be arranged to interface with a card key type Security System for all building floors.

For the purposes of the present specification, the above-mentioned terms are defined in the following manner:

Waiting Time:—Time from the registration of a call to the arrival of the car and opening of its doors. Not including extended approach time.

Trip Time:—The time from boarding to arrival at destination, including initial door dwell and close and arrival door open times.

Destination Time:—The sum of "Waiting Time" and "Trip Time"

Round Trip Time:—Time from trip origin to the second directional change.

Origin:—The location of the DIT or peripheral means of demand input.

Destination:—The registered intended floor.

Car Response Zones:—The floors to or from which a car is eligible for ORIGIN or DESTINATION assignment.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed is:

1. A computer program product for enabling a computer to equalize service characteristics and equipment usage in an elevator group supervisory system, said computer program product comprising:

software instructions for enabling the computer to perform predetermined operations including the steps of:

(a) receiving at least one user input from at least one data input terminal, (b) determining a location of an originating demand unique to each said user inputs, (c) determining a location of a destination demand unique to each said user inputs, (d) calculating a total number of said user inputs received within a predetermined time interval, (e) determining whether said total number of user inputs is less than or more than a total number of available elevators, (f) assigning an elevator to each said location of said originating demand, (g) forming temporary call response zones based upon said elevator assignments;

wherein average waiting times, loading times and travel times are reduced for providing optimum demand response.

2. The computer program product of claim 1, wherein step (f) further includes the step of:

allocating an equal number of assignments to each elevator if said total number of user inputs is greater than said total number of available elevators.

3. The computer program product of claim 1, wherein step (f) further includes the step of:

assigning coincidental ones of said destination and origination demands to a same elevator in the following order:

(1) elevators with unique one of said origination and destination demands, (2) elevators with unique one of said origination and destination demands with a unique one of said call response zones, (3) elevators with a unique one of said destination and origination demands within a unique one of said call response zones, and (4) elevators with more than one unique origination and destination demands.

4. The computer program product of claim 1, further comprising the steps of:

(h) assigning an elevator to a new one of said origination and destination demands such that coincidental ones of said destination and origination demands are assigned to a same elevator in the following order:

(1) elevators with unique one of said origination and destination demands, (2) elevators with unique one of said origination and destination demands with a unique one of said call response zones, (3) elevators with a unique one of said destination and origination demands within a unique one of said call response zones, and (4) elevators with more than one unique origination and destination demand.

5. A computer system adapted to equalize service characteristics and equipment usage in an elevator group supervisory system, said computer system comprising:

a processor;

a memory including software instructions that cause the computer system to perform the steps of:

(a) receiving at least one user input from at least one data input terminal, (b) determining a location of an originating demand unique to each said user inputs, (c) determining a location of a destination demand unique to each said user inputs, (d) calculating a total number of said user inputs received within a predetermined time interval, (e) determining whether said total number of user inputs is less than or more than a total number of available elevators, (f) assigning an elevator to each said location of said originating demand, (g) forming temporary call response zones based upon said elevator assignments;

wherein the computer system minimizes average waiting times, loading times and travel times for providing optimum demand response.

6. The computer system of claim 5, wherein step (f) further includes the step of:

allocating an equal number of assignments to each elevator if said total number of user inputs is greater than said total number of available elevators.

7. The computer system of claim 5, wherein step (f) further includes the step of:

assigning coincidental ones of said destination and origination demands to a same elevator in the following order:

(1) elevators with unique one of said origination and destination demands, (2) elevators with unique one of said origination and destination demands with a unique one of said call response zones, (3) elevators with a unique one of said destination and origination demands within a unique one of said call response zones, and (4) elevators with more than one unique origination and destination demands.

8. The computer system of claim 5, further comprising the steps of:

(h) assigning an elevator to a new one of said origination and destination demands such that coincidental ones of said destination and origination demands are assigned to a same elevator in the following order:

(1) elevators with unique one of said origination and destination demands, (2) elevators with unique one of said origination and destination demands with a unique one of said call response zones, (3) elevators with a unique one of said destination and origination demands within a unique one of said call response zones, and (4) elevators with more than one unique origination and destination demand.

* * * * *